United States Patent [19]

Sato

[11] Patent Number: 5,022,815

[45] Date of Patent: Jun. 11, 1991

[54] STRUCTURE FOR MOUNTING A FAN TO A FAN MOTOR

[75] Inventor: Masaei Sato, Yabuzuka-hommachi, Japan

[73] Assignee: Mitsuba Electric Manufacturing Co., Ltd., Gumma, Japan

[21] Appl. No.: 403,817

[22] Filed: Sep. 7, 1989

[30] Foreign Application Priority Data

Sep. 24, 1988 [JP] Japan ..... 63-124890[U]

[51] Int. Cl.[5] ..... F01D 3/04

[52] U.S. Cl. ..... 415/107; 415/131; 384/626; 403/355

[58] Field of Search ..... 416/204 R; 415/131, 415/132, 104, 107; 403/355, 360, 365; 384/420, 425, 426, 626

[56] References Cited

U.S. PATENT DOCUMENTS 3,169,486 2/1965 Freed ..... 415/131

4,687,411 8/1987 Maeda et al. ..... 384/626

*Primary Examiner*—John T. Kwon

*Attorney, Agent, or Firm*—Oliff & Berridge

[57] ABSTRACT

The invention concerns a structure for mounting a fan to a fan motor. The structure is designed to fit a plurality of thrust washers onto the end of a motor shaft supported in a casing through a bearing and to thrust and fit a flat washer on a peripheral surface of a smaller diameter step formed on the tip side further than the washers-fitted section. Of these thrust washers, the most outer, tip side, thrust washer located opposite to the flat washer is thicker than the traveling play distance toward the core of a motor shaft and thinner than the interval from the adjacent thrust washer to the peripheral surface of the step. With the construction, hence, the invention serves to prevent the thrust washer from falling onto the smaller diameter step.

1 Claim, 2 Drawing Sheets

STRUCTURE FOR MOUNTING A FAN TO A FAN MOTOR

BACKGROUND OF THE INVENTION

1. Technical Field

The present invention relates to a structure of mounting a fan to a fan motor used for cooling a radiator or air-conditioner, for example.

2. Description of the Prior Art

Referring to FIG. 3, the conventional electric motor fan has a fan-mounting seat structure wherein a plurality of thrust washers 5 are fitted into a tip section supported on a casing 1 through a bearing 3 and a flat washer 7 is thrust on a peripheral surface of a smaller diameter step formed on the tip section. However, since the thrust washer 5 is made of a thin plate, the outermost thrust washer 5 located opposite to the flat washer 7 may be mounted in the state that it is departed from the smaller diameter step. This drawback can be prevented when mounting the thrust washers 5. Yet, since a motor shaft 2 provides such small play as allowing its travel to the shaft core, at a stage of fastening a fan boss with a nut after mounting the thrust washers 5 safely, the motor shaft 3 may be slipped (that is, the motor shaft 2 is moved from the rightmost thrusting state as shown in FIG. 3 to the leftmost state where the left end of the motor shaft is pressed on a casing bottom), thereby often causing the thin tabular thrust washer 5 to fall onto the small diameter section. In this state, if the fan is installed thereto, the fan does not match to the core of the motor shaft, resulting in causing adverse effects on smooth rotation of the fan and drawbacks such as vibrations or abnormal wear on a bearing.

SUMMARY OF THE INVENTION

In order to overcome the foregoing drawbacks, it is, therefore, an object of the invention to provide a fan-mounting structure which is capable of avoiding these drawbacks. The invention includes a fan-mounting seat constructed to have a plurality of thrust washers fitted onto the end of a motor shaft supported on a casing through a bearing and a flat washer thrust on a peripheral surface of a smaller diameter step formed on a tip side beyond the fitting section. The thrust washer on the tip side, which is opposite to the flat washer, has a thickness which is thicker than a traveling play distance toward the shaft core of the motor shaft and is thinner than an interval from the adjacent thrust washer to the peripheral surface of the smaller diameter step.

And, the foregoing construction makes it possible to prevent the thrust washer from being falling onto the smaller diameter step.

PREFERRED EMBODIMENT OF THE INVENTION

Figure 1:
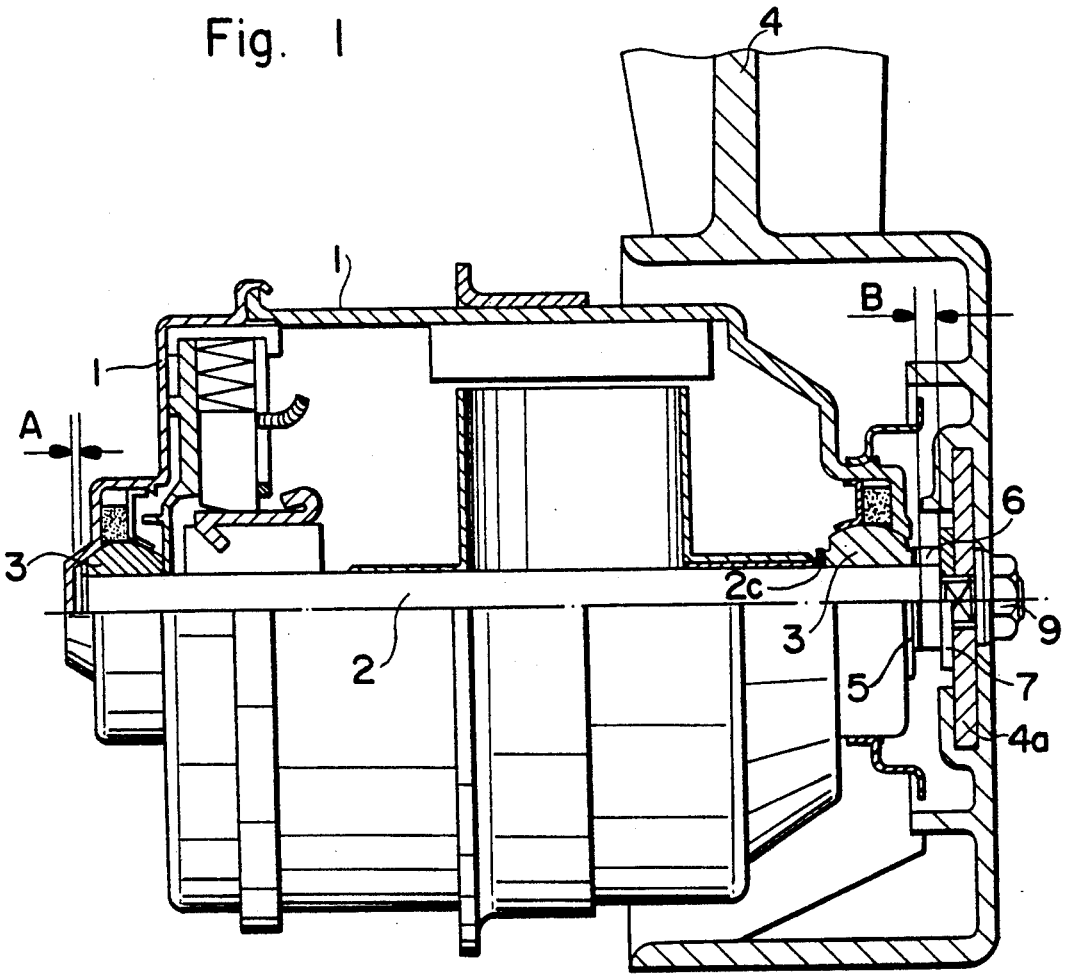
FIG. 1 is a partially-broken side elevation showing a fan motor.
Figure 2:
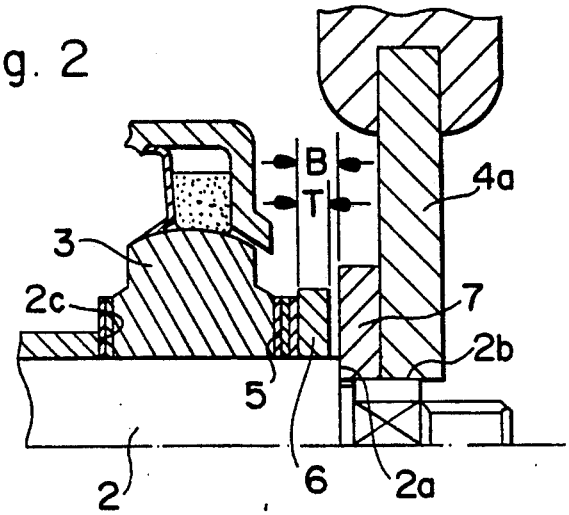
FIG. 2 is an expanded sectional view showing an essential portion of the fan motor.
Figure 3:
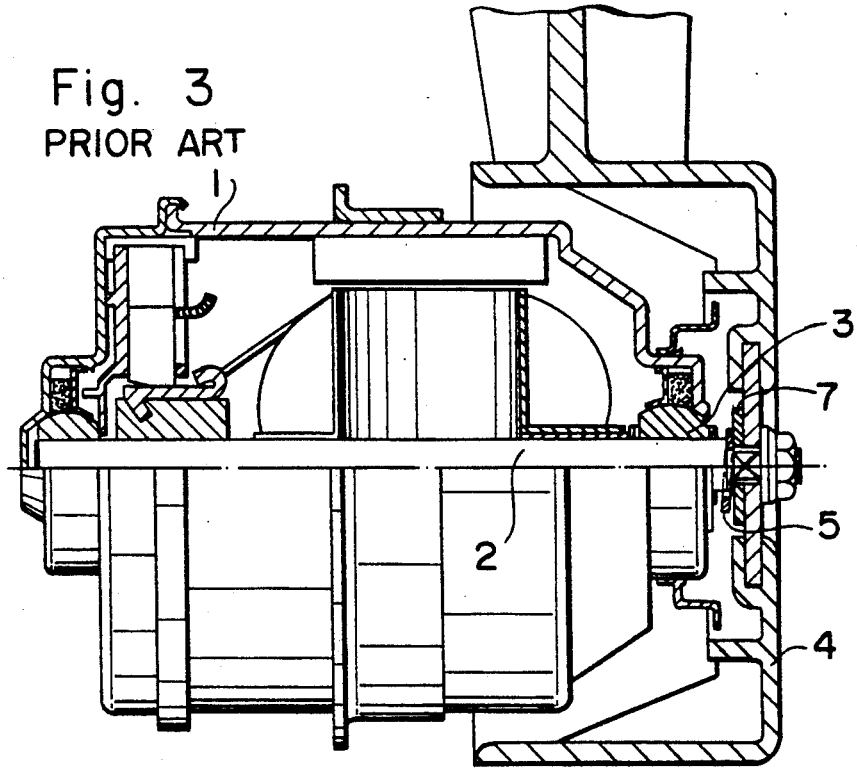
Fig. 3 PRIOR ART
FIG. 3 is a section view showing an essential portion of the prior art.

A preferred embodiment of the invention will be described with reference to the drawings. In these drawings, 1 denotes a casing for an electric fan motor. Both ends of a motor shaft 2 composing a rotor is rotatably supported in the motor casing 1 through a bearing. A fan 4 is integrally mounted to one end projected from the casing 1 as described below. And, the motor shaft 2 includes a step section **2*c* formed to restrict the axial travel (travel in the right-hand direction viewed in the drawing). The step section 2*c* is thrust on the bearing 3 through a washer, thereby restricting the right-hand further travel of the motor shaft 2. Assuming that A denotes a gap (traveling play distance) given when the step 2*c* comes closest to the bearing 3, that is, when the other end of the motor shaft 2 is most isolated from the bottom of the casing 1** (bottom of an end bracket), the motor shaft can be traveled toward the shaft core by the gap A.

The projected portion of the motor shaft 2 includes thrust washers 5, 6, and a flat washer 7 mounted from the bearing 3 in sequence. A smaller diameter step **2*b* is formed on the portion of the bearing shaft 2 located further toward the shaft end (tip) than the thrust washer fitting section. The flat washer 7 is thrust on the peripheral surface 2*a* of the smaller diameter step 2*b*. An insert plate 4*a* formed on a fan boss is thrust and fitted into a fan-mounting seat provided by the flat washer 7 and is fastened with a nut 9. A thickness T of the thrust washer 6 located on the tip side and opposite to the flat washer 7 is made larger than the traveling play distance A toward the shaft core of the motor shaft 2 and smaller than an interval B from the adjacent thrust washer 5 to the peripheral surface 2*a*** of the step ($A<T<B$).

In the preferred embodiment having the foregoing construction, for mounting the fan 4, as stated above, the necessary number of thrust washers 5, 6, the flat washer 7, and the insert plate **4*a* are fitted to the projected portion of the motor shaft 2 in sequence and then the fan 4 is fastened with the nut 9. In order to form a fan-mounting seat, the thrust washer located on the tip side and opposite to the flat washer 7 has a thickness T which is thicker than the traveling play distance A toward the shaft core of the motor shaft 2, i.e., along the longitudinal axis of the shaft. The interval B from the adjacent thrust washer 5 to the peripheral surface 2*a* of the step is made larger than the traveling play distance A toward the shaft core of the motor shaft 2, so that the motor shaft 2 moves to the furthest point on the casing bottom side without the tip side thrust washer 6 falling onto the smaller diameter step 2*b*. Hence, the fan 4 is mounted in a manner to allow itself to match to the core of the motor shaft 2, thereby preventing smooth rotation of the shaft from being damaged and drawbacks such as vibrations or abnormal wear on a bearing from being caused. And, the fan 4 is mounted on the flat washer 7 serving as its mounting seat and is fastened with the nut 9. The thickness T of the tip side thrust washer 6 is made thinner than the interval B from the adjacent thrust washer 5 to the peripheral surface 2*a* of the smaller diameter step 2*b*. With the shaft being fastened by the nut, therefore, no stubborn force is applied onto the thrust washers 5, 6 from the flat washer 7 side, thereby keeping a playing state and effectively exerting the thrust function. It results in preventing smooth rotation performance of the motor shaft 2** from being damaged.

As set forth above, according to the invention, a plurality of thrust washers are fitted onto the tip section of the motor shaft supported on the casing through the bearing. The tip side thrust washer of them has a thickness which is thicker than the traveling play distance toward the core of the motor shaft. Even if the motor shaft travels toward the core of the motor shaft in the play range, the tip side thrust washer does not fall onto the smaller diameter step. And, its thickness is thinner than the interval from the adjacent thrust washer to the peripheral surface of the smaller diameter step. Hence, even if the fan is fastened, the thrust washers are not fastened with each other, thereby surely offering a thrust effect. The fan is, therefore, mounted to the shaft in a manner to allow itself to match to the core of the motor shaft, resulting in preventing smooth rotation from being damaged and drawbacks such as vibrations or abnormal wear on a bearing.

What is claimed is:

1. A structure for mounting a fan to a fan motor, comprising:

a fan motor shaft supported in a motor casing through a bearing;

a fan-mounting seat provided on the motor shaft adjacent an end thereof, said seat including a thrust washer fitting section and a stepped section beyond the thrust washer fitting section toward said end of the motor shaft, said stepped section having a smaller diameter than the thrust washer fitting section;

a plurality of thrust washers fit onto said thrust washer fitting section; and a flat washer fitted onto the peripheral surface of said stepped section;

wherein, an outermost thrust washer of said plurality of thrust washers, located opposite to the flat washer, has a thickness greater than a traveling play distance of the motor shaft along a longitudinal axis of the motor shaft, and less than an interval from an immediately adjacent thrust washer to the peripheral surface of the stepped section.

* * * * *